US006977129B2

(12) United States Patent
Saito et al.

(10) Patent No.: US 6,977,129 B2
(45) **Date of Patent: *Dec. 20, 2005**

(54) CHARGE CONTROL AGENT, TONER USING SAME DEVELOPER CONTAINING THE TONER AND DEVELOPING DEVICE CONTAINING THE DEVELOPER

(75) Inventors: Takuya Saito, Numazu (JP); Masanori Suzuki, Shizuoka-ken (JP); Yohichiroh Watanabe, Fuji (JP); Keiko Shiraishi, Susono (JP); Toyoshi Sawada, Odawara (JP); Tatsuhiko Osaki, Toyohashi (JP); Satoshi Aratani, Gamagoori (JP); Hiroki Ogiso, Gamagoori (JP)

(73) Assignees: Ricoh Company, Ltd., Tokyo (JP); Takemoto Yushi Kabushiki Kaisha, Gamagoori (JP)

( * ) Notice: Subject to any disclaimer, the term of this patent is extended or adjusted under 35 U.S.C. 154(b) by 2 days.

This patent is subject to a terminal disclaimer.

(21) Appl. No.: 10/314,241

(22) Filed: Dec. 9, 2002

(65) Prior Publication Data

US 2003/0162018 A1 Aug. 28, 2003

(30) Foreign Application Priority Data

Dec. 10, 2001 (JP) ..... 2001-375887

(51) Int. Cl.[7] ..... G03G 9/08
(52) U.S. Cl. ..... 430/108.4; 430/120; 430/108.5
(58) Field of Search ..... 430/120, 108.5, 430/109.3, 108.4, 109.2, 109.4

(56) References Cited

U.S. PATENT DOCUMENTS

| | | | | |
|---|---|---|---|---|
| 4,083,894 A | | 4/1978 | Kusunose et al. | |
| 4,246,378 A | * | 1/1981 | Kometani et al. | 525/438 |
| 4,749,638 A | * | 6/1988 | Tsushima et al. | 430/108.4 |
| 4,762,763 A | | 8/1988 | Nomura et al. | |
| 4,917,982 A | * | 4/1990 | Tomono et al. | 430/108.4 |
| 6,004,715 A | | 12/1999 | Suzuki et al. | |
| 6,074,795 A | | 6/2000 | Watanabe et al. | |
| 6,103,441 A | | 8/2000 | Toimita et al. | |
| 6,140,003 A | * | 10/2000 | Sacripante et al. | 430/108.4 |
| 6,180,298 B1 | | 1/2001 | Kuroda et al. | |
| 6,335,137 B1 | | 1/2002 | Suzuki et al. | |
| 6,468,706 B2 | | 10/2002 | Matsuda et al. | |

FOREIGN PATENT DOCUMENTS

| | | | |
|---|---|---|---|
| EP | 0 201 340 | | 11/1986 |
| GB | 1155353 | * | 6/1969 |
| JP | 61-3149 | | 1/1986 |
| JP | 1-306861 | | 12/1989 |

OTHER PUBLICATIONS

Borsenberger, Paul M. Organic Photoreceptors for Imaging Systems. New York: Marcel–Dekker, Inc. (1993) pp. 10–15.*
U.S. Appl. No. 10/647,346, filed Aug. 26, 2003, Suzuki et al.
U.S. Appl. No. 10/444,013, filed May 23, 2003, Sawada et al.
U.S. Appl. No. 10/674,358, filed Oct. 1, 2003, Sugiyama et al.
U.S. Appl. No. 10/670,320, filed Sep. 26, 2003, Watanabe et al.
U.S. Appl. No. 10/163,530, filed Jun. 7, 2002, pending.
U.S. Appl. No. 10/102,629, filed Mar. 22, 2002, pending.
U.S. Appl. No. 10/079,878, filed Feb. 22, 2002, pending.
U.S. Appl. No. 09/988,142, filed Nov. 19, 2001, pending.
U.S. Appl. No. 09/993,606, filed Nov. 27, 2001, pending.
U.S. Appl. No. 09/891,652, filed Jun. 26, 2001, unknown, unknown.
U.S. Appl. No. 09/820,609, filed Mar. 30, 2001, pending.
U.S. Appl. No. 10/871,580, filed Jun. 21, 2004, Ohtani et al.
U.S. Appl. No. 10/876,718, filed Jun. 28, 2004, Sugiyama et al.
U.S. Appl. No. 10/800,636, filed Mar. 16, 2004, Hasegawa et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A charge control agent containing a calcium salt of a sulfoisophthalic acid compound. A toner for developing an electrostatic latent image including the above charge control agent, a binder resin and a colorant.

16 Claims, 1 Drawing Sheet

CHARGE CONTROL AGENT, TONER USING SAME DEVELOPER CONTAINING THE TONER AND DEVELOPING DEVICE CONTAINING THE DEVELOPER

BACKGROUND OF THE INVENTION

1. Field of the Invention

This invention relates to a charge control agent useful for controlling triboelectricity of a toner for developing an electrostatic latent image. The present invention is also directed to a toner for use in developing an electrostatic latent image in an image forming method such as electrophotography, electrostatic recording and electrostatic printing and to a developing device using the developer.

2. Description of the Prior Art

Methods for developing an electrostatic latent image to form a toner image include a method using a one-component type developer composed only of a toner and a method using a two-component type developer composed of a toner and a carrier which are charged in opposite polarity. The one-component type method may be, for example, a powder cloud developing method in which toner particles are sprayed over an electrostatic latent image-bearing surface, a contact developing method (touch down method) in which a latent image-bearing surface is directly contacted with a bed of toner, or a dielectric developing method in which a latent image-bearing surface is contacted with a magnetic, electrically conductive toner. The two-component type method may be, for example, a magnet brush method using iron powder as a carrier, a cascade method in which glass beads are used as a carrier or a fur brush method in which a fiber brush is used as a carrier.

In the above developing systems, fine particles each composed of a matrix of a synthetic or natural binder resin, such as a polystyrene resin, and a colorant, such as carbon black, dispersed in the matrix are generally used as a toner. Such a toner is finely divided into a particle size of, for example, 1–30 $\mu$m. In the case of a magnetic toner, a magnetic material such as magnetite is incorporated into the above toner.

Toner to be used for developing an electrostatic latent image is positively or negatively charged according to the polarity of the electrostatic latent image to be developed. Because the amount of charges generated by using the triboelectricity of the binder resin is small, a charge control agent is generally incorporated into the toner to obtain clear images.

Known charge controlling agents include metal complexes of monoazo dyes; humic or nitrohumic acid or a salt thereof; metal complexes (e.g. Ni, Co, Cr, and Fe metal complexes) of aromatic hydroxycarboxylic or dicarboxylic acids such as salicylic acid, naphthoic acid and dicarboxylic acid; sulfonated copper phthalocyanine pigments; nitrified or halogenated styrene oligomers; chlorinated paraffins; and melamine resins. The known charge controlling agents, however, suffer from one or more defects such as non-uniformity in triboelectricity and susceptibility to decomposition during kneading. Further, the use of a charge control agent containing heavy metals such as chromium, nickel, chromium and zinc has environmental problems and safety problems against human bodies.

JP-A-H01-306861 discloses the use of an organic boron compound as a charge control agent. JP-A-S61-3149 discloses the use of a bisphenol compound as a charge control agent. These charge control agents are, however, hygroscopic in nature and are apt to cause a change in their triboelectricity. Additionally, they do not have highly satisfactory triboelectricity.

Incidentally, a polyester resin or an epoxy resin is now increasingly used as a binder resin for toners because of their advantages that these resins do not adversely affect the inherent color of colorants thereof, that these resins have good resistance to tackiness to polyvinyl chloride mats and that these resins have good preservation stability and yet permit low temperature fixation. When these binder resins are used in conjunction with the above known charge control agents, sufficiently high triboelectricity cannot be obtained or the triboelectricity gradually reduces even when the initial triboelectricity is high, so that problems of fatigue or toner dispersion are apt to be caused. Probably, the problems are attributed to the presence of —COOH and —OH functional groups in these resins which groups would prevent maintenance of stable triboelectricity of the charge control agents.

Conventionally, an oil is applied to a heated roll to prevent "hot offset" which is a phenomenon occurring in fixation of toner image on paper with a heated roll and refers to deposition of fused toner onto the heated roll. The use of the oil requires the installation of an oil tank and hinders compactness of the apparatus. Recent trend is toward incorporation of a wax into the toner for improving releasability. The use of wax, however, reduces the fluidity of the toner particles and, hence, it becomes difficult to obtain desired amount of charge in a moment by friction. Since the frictional contact time in the case of a one-component type toner is much shorter than that for a two-component type toner, there is a great demand for a charge control agent having excellent triboelectricity.

Additionally, there is an increasing demand for white or colorless charge control agents which can be suitable used for color toners. Currently available white or colorless charge control agents, however, do not have good charging characteristics or are very expensive.

SUMMARY OF THE INVENTION

It is, therefore, an object of the present invention to provide a charge control agent which, when incorporated into toner particles, can exhibit triboelectricity suitable for a given image developing system upon frictional contact between toner particles, between toner and carrier, between toner and a developer bearing member (such as a developer sleeve) and between toner and a thickness regulating member (such as a blade) and which can maintain the charging amount in a stable manner.

Another object of the present invention is to provide a charge control agent of the above-mentioned type which can afford suitable charging amount in a moment irrespective of presence or absence of a releasing agent and of difference is the developing system.

It is a further object of the present invention to provide a charge control agent which can be suitably used for both one-component type and two-component type developers.

It is yet a further object of the present invention to provide a charge control agent which can provide stable charging amount even placed in different environmental conditions.

It is yet a still further object of the present invention to provide a charge control agent which do not adversely affect the color tone of a colorant conjointly contained in toner.

It is a further object of the present invention to provide a charge control agent which has a good heat resistance and can withstand kneading conditions for the preparation of toners.

It is a further object of the present invention to provide a charge control agent which has poor affinity with moisture.

It is a further object of the present invention to provide a charge control agent which is cheap and can reduce the cost of the toner.

It is an important object of the present invention to provide a toner containing the above charge control agent and exhibiting excellent properties attributed to the charge control agent.

In accomplishing the foregoing objects, there is provided in accordance with one aspect of the present invention a charge control agent comprising a calcium salt of an organic acid compound.

It has been found that the calcium salt of an organic acid compound exhibits excellent triboelectricity and can keep the charging amount substantially unchanged even when the environmental conditions change. In particular, the amount of moisture absorbed by the calcium salt of an organic acid compound does not significantly change, even when the environmental conditions change. Further, the calcium salt of an organic acid compound does not decompose in a temperature range (generally 200° C. or less) in which it is kneaded with a binder resin and a colorant for the preparation of toner. Therefore, a toner containing the calcium salt of an organic acid compound as a charge controlling agent can be charged in a stable manner with the charging amount being maintained constant irrespective of a change in environmental conditions under which the toner is prepared or charged. This effect is significant in the case of a calcium salt of an aromatic sulfonic acid compound, probably because of increased hydrophobicity thereof. Another advantage of the charge controlling agent of the present invention is that the toner can be instantaneously charged in a suitable charging amount. Generally, it is known that a releasing agent such as a wax adversely affect the chargeability of the toner. A toner containing the charge controlling agent according to the present invention, however, can be quickly charged, even when a releasing agent is present. Thus, the charge controlling agent is suitably used for a toner containing the releasing agent. An additional merit of the charge controlling agent of the present invention is that it is white. Therefore, the charge controlling agent does not injure the color of the toner and, thus, is suitably used for color toner for the formation of full-color or multi-color images.

In another aspect, the present invention provides a toner for developing an electrostatic latent image, comprising a binder resin, a colorant and a charge control agent as defined above.

The present invention also provides a developer for developing an electrostatic latent image, comprising a toner as defined above.

The present invention further provides a developing device comprising a developing member, and a developer carried on said developing member and comprising a toner as defined above.

The present invention further provides a composition of matters, comprising a calcium salt of an organic acid compound, and a resin in which said calcium salt is dispersed.

The present invention further provides a shaped body of the above composition.

BRIEF DESCRIPTION OF THE DRAWING

Other objects, features and advantages of the present invention will become apparent from the detailed description of the preferred embodiments of the invention which follows, when considered in the light of the accompanying drawing, in which.

DETAILED DESCRIPTION OF THE PREFERRED EMBODIMENTS OF THE INVENTION

Figure 1:
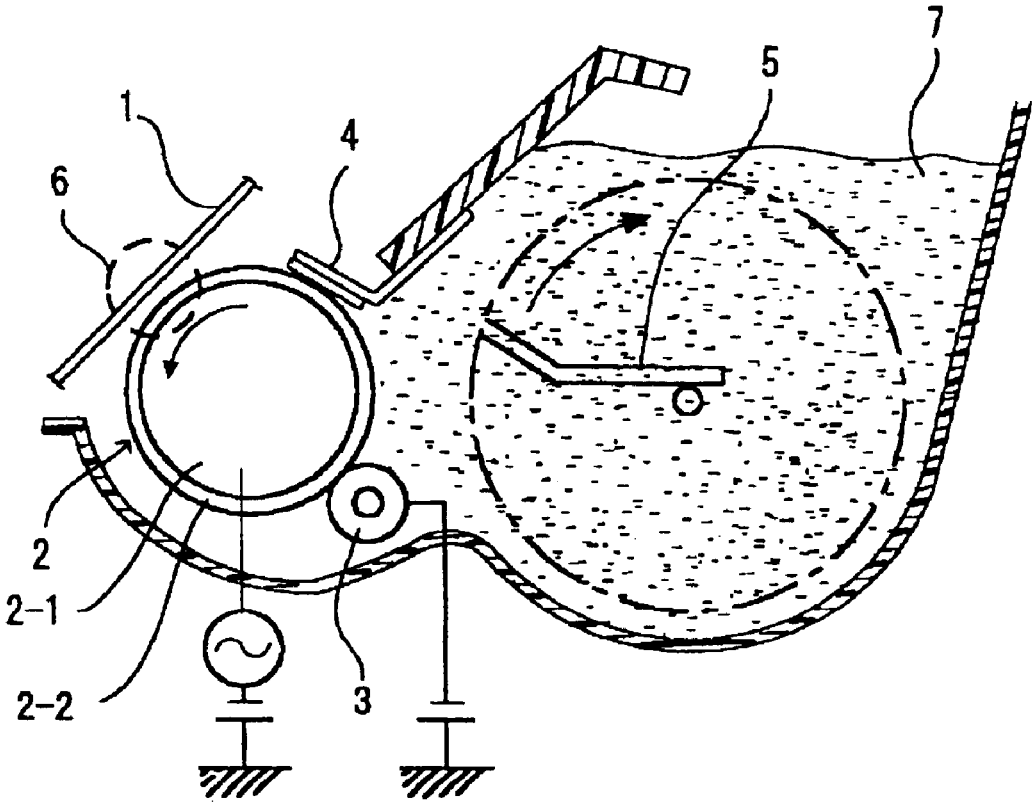
FIG. 1 is a schematic illustration in cross-section of a developing device according to the present invention.

The charge control agent of the present invention comprises a calcium salt of an organic acid compound. The term "organic acid compound" is intended to refer to an organic acid or a derivative thereof. The organic acid may be an organic compound having one or more acid groups such as a carboxyl group (—COOH), a sulfonic group (—$SO_3H$) and a hydroxyl group (—OH).

The carboxylic acid may be an aromatic or aliphatic carboxylic acid such as terephthalic acid, isophthalic acid, orthphthalic acid, 2,6-naphthalenedicarboxylic acid, diphenic acid, palmitic acid, stearic acid or salicylic acid.

The sulfonic acid is preferably an aromatic sulfonic acid such as carboxybenzenesulfonic acid, dicarboxybenzenesulfonic acid, hydroxymonocarboxybenzenesulfonic acid, dihydroxymonocarboxybenzenesulfonic acid, monoalkylmonocarboxybenzenesulfonic acid, monohydroxydicarboxybenzenesulfonic acid, monoalkyldicarboxybenzenesulfonic acid, dialkyldicarboxybenzenesulfonic acid, monohydroxymonocarboxynaphthalenesulfonic acid, trihydroxymonocarboxynaphthalenesulfonic acid, dialkylmonocarboxynaphthalenesulfonic acid or derivatives thereof in which the carboxy group or groups are esterified.

A calcium salt of a benzenesulfonic acid compound shows excellent turboelectricity and, when incorporated into a toner as a charge controlling agent, gives stable charges to the toner with a suitable charging amount. Especially, a calcium salt of a sulfoisophthalic acid compound represented by the following formula (1):

(1)

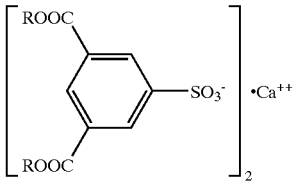

wherein R is a hydrogen atom or a hydrocarbyl group having 1 to 8 carbon atoms, is preferred, since a toner containing such a calcium salt can be quickly charged in a stable manner with a suitable charging amount.

In the above formula (1), the hydrocarbyl group R may be a linear aliphatic hydrocarbon group such as methyl, ethyl, n-propyl, i-propyl, n-butyl, t-butyl, n-pentyl, n-hexyl, n-heptyl or n-octyl, a cyclic aliphatic hydrocarbon group such as cyclohexyl, an aryl group such as phenyl or an aralkyl group such as benzyl. For reasons of stability in triboelectricity, a dimethyl ester represented by the following formula (2):

(2)

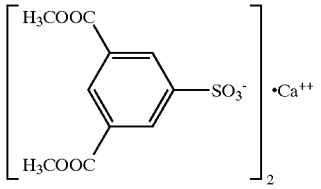

is preferably used as the calcium salt of a sulfoisophthalic acid compound.

Specific examples of the calcium salt of a sulfoisophthalic acid compound of the above formula (1) include:

5-sulfoisophthalic acid calcium salt (compound of the above formula (1) in which R is a hydrogen atom), dimethyl 5-sulfoisophthalate calcium salt (compound of the above formula (2)), diethyl 5-sulfoisophthalate calcium salt, dipropyl 5-sulfoisophthalate calcium salt, diisopropyl 5-sulfoisophthalate calcium salt, dibutyl 5-sulfoisophthalate calcium salt, diisobutyl 5-sulfoisophthalate calcium salt, di-t-butyl 5-sulfoisophthalate calcium salt, dipentyl 5-sulfoisophthalate calcium salt, di-1-methylbutyl 5-sulfoisophthalate calcium salt, di-1-ethylpropyl 5-sulfoisophthalate calcium salt, diisoamyl 5-sulfoisophthalate calcium salt, di-2,2-dimethylpropyl 5-sulfoisophthalate calcium salt, dihexyl 5-sulfoisophthalate calcium salt, di-1-methylpentyl 5-sulfoisophthalate calcium salt, di-1-ethylbutyl 5-sulfoisophthalate calcium salt, di-1,3-dimethylbutyl 5-sulfoisophthalate calcium salt, di-1,1,2-trimethylpropyl 5-sulfoisophthalate calcium salt, 1,2,2-trimethylpropyl 5-sulfoisophthalate calcium salt, diheptyl 5-sulfoisophthalate calcium salt, di-1-methylhexyl 5-sulfoisophthalate calcium salt, di-1,1-dimethylpentyl 5-sulfoisophthalate calcium salt, bis-diisopropylmethyl 5-sulfoisophthalate calcium salt, dioctyl 5-sulfoisophthalate calcium salt, di-1-methylheptyl 5-sulfoisophthalate calcium salt, di-1-ethylhexyl 5-sulfoisophthalate calcium salt, di-1-ethyl-3-methylpentyl 5-sulfoisophthalate calcium salt and di-2-ethylhexyl 5-sulfoisophthalate calcium salt.

The charge control agent is suitably applied to a toner for developing an electrostatic latent image. Thus, in one aspect of the present invention, there is provided a toner including a binder resin, a colorant and the above charge control agent. The toner may be used for both a one-component type developer and a two-component developer and may include any ingredients conventionally known for the preparation of toners. Description will be next made of typical ingredients of the toner.

Illustrative of suitable binder resins are homopolymers or copolymers of two or more of the following monomers: styrene or its homologues such as chlorostyrene, vinyltoluene, vinyl chloride, vinyl acetate, vinyl propionate, methyl (meth)acrylate, ethyl (meth)acrylate, propyl (meth) acrylate, n-butyl (meth)acrylate, isobutyl (meth)acrylate, dodecyl (meth)acrylate, 2-ethylhexyl (meth)acrylate, lauryl (meth)acrylate, 2-hydroxyethyl (meth)acrylate, hydroxypropyl (meth)acrylate, 2-chloroethyl (meth)acrylate, (meth) acrylonitrile, (meth)crylamide, (meth)acrylic acid, vinyl ethyl ether, vinyl methyl ether, vinyl isobutyl ether, vinyl methyl ketone, N-vinyl pyrrolidone, N-vinylpyridine and butadiene. Other resins such as polyester resins, polyurethane resins, polyol resins, polyamide resins, epoxy resins, rosins, modified rosins, terpene resins, phenolic resins, hydrogenated petroleum resins, ionomer resins, silicone resins, ketone resins, and xylene resins may also be used. Mixtures of two or more of the above homopolymers, copolymers and resins may also be used.

Polyester resins, epoxy resins and polyol resins obtained from epoxy resins have an advantage over conventionally widely used styrene-acrylate copolymer resins with respect to preservability and fixing properties but are disadvantageous with respect to charging amount. Since the charge control agent according to the present invention has high triboelectricity, polyester resins, epoxy resins or polyol resins can be suitably used as a binder resin for the toner of the present invention. The toner containing these resins can exhibit the above-mentioned advantages of these resins with respect to preservability and fixing properties as well as excellent frictional electrification properties.

Any known colorant may be used for the purpose of the invention. The colorant may be, for example, carbon black, a nigrosine dye, iron black, Naphthol Yellow S, Hansa Yellow (10G, 5G, G, GR, A, RN and R), cadmium yellow, Chinese yellow, chrome yellow, yellow iron oxide, titanium yellow, Polyazo Yellow, Oil Yellow, Pigment Yellow L, Benzidine Yellow (G and GR), Permanent Yellow NCG, Vulcan Fast Yellow, Tartradine Lake, Quinoline Yellow Lake, Anthrazan Yellow BGL, Isoindolinone Yellow, red iron oxide, red lead, lead vermilion, cadmium red, cadmium mercury red, antimony vermilion, Permanent Red 4R, Para Red, Fisay Red, parachloro-orthonitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Lubin B, Brilliant Scarlet G, Lithol Lubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, Oil Red, Quinacridon Red, Pyrazolon Red, Polyazo Red, chrome vermilion, Benzidine Orange, Perinon Orange, Oil Orange, Cobalt Blue, Selulian Blue, Alkali Blue Lake, Peacock Blue Lake, Victoria Blue Lake, non-metal Phthalocyanine Blue, Phthalocyanine Blue, Fast Sky Blue, Indanthrene Blue (RS and BC), Indigo, Iron Blue, Ultramarine Blue, Anthraquinone Blue, Fast Violet B, Methyl Violet Lake, Cobalt Vilet, Manganese Violet, Dioxan Violet, Anthraquinone Violet, Chrome Green, Zinc Green, chromium oxide, Pylidian, Emerald Green, Pigment Green B, Naphthol Green B, Green Gold, Acid Green Lake, Marakite Green Lake, Phthalocyanine Green, Anthraquinone Green, titanium oxide, Chinease White or Lithopone. These colorants may be used by themselves or in combination with two or more. The colorant is generally used in an amount of 0.1 to 50 parts by weight per 100 parts by weight of the binder resin.

The toner of the present invention may contain another charge control agent in addition to the above-described charge control agent for enhancing the chargeability thereof, if desired. Any charge control agent generally used in the field of toners for use in developing an electrostatic latent image may be used for the purpose of the present invention. Examples of such additional charge control agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing surfactant, a metal salt of salicylic acid and a metal salt of a salicylic acid derivative.

The amount of the charge control agent (including the additional charge control agent) used for enhancing the chargeability use in the color toner may be determined in light of the amount of the charge control agent, the kind of binder resin to be employed, the presence or absence of additives, and the preparation method of the toner including the method of dispersing the composition of the toner. It is preferable that the amount of the additional charge controlling agent be in the range of 0.1 to 10 parts by weight, and more preferably in the range of 2 to 5 parts by weight, per 100 parts by weight of the binder resin. By the addition of the additional charge controlling agent in such an amount, sufficient chargeability for use in practice can be imparted to the toner. Further, electrostatic attraction of the toner to a developing roller can be prevented, so that the decrease of fluidity of the developer and the decrease of image density can be prevented.

A releasing agent may be suitably incorporated into the toner. Any known releasing agent may be suitably used for the purpose of the present invention. Wax is generally used as a releasing agent. Examples of the wax include low molecular weight polyolefin wax such as low molecular weight polyethylene wax and low molecular weight polypropylene wax; synthetic hydrocarbon wax such as Fischer-Tropsh wax; natural wax such as carnauba wax, candelilla wax, rice wax, montan wax; petroleum wax such as paraffin wax and microcrystalline wax; higher fatty acids such as stearic acid, palmitic acid and millystyric acid; metal salts or amides of higher fatty acids; and modified waxes of the above waxes. These waxes may be used singly or in combination of two or more thereof. It is preferred that the wax have a melting point in the range of 70° C. to 125° C. for reasons of satisfactory transferability, duration and releasability. The releasing agent is generally used in an amount of 1 to 15% by weight based on the weight of the toner.

The toner of the present invention may contain a magnetic material to provide a magnetic toner. The magnetic material may be, for example, iron oxide. (e.g. magnetite, ferrite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium. Above all, use of magnetite is preferred. The magnetic particles preferably have an average particle diameter of 0.1 to 2 $\mu$m and are preferably used in an amount of 20 to 200 parts by weight, preferably 40 to 150 parts by weight, per 100 parts by weight of the binder resin of the toner.

In addition, the toner of the present invention may contain an external additive such as silica powder, metal salts of fatty acids (such as zinc stearate and aluminum stearate), metal oxides (titanium oxide, aluminum oxide, tin oxide and antimony oxide) and fluoropolymers.

The toner of the present invention may be prepared by any conventionally known method. The toner preferably has a volume particle diameter of 4–10 $\mu$m for reasons of prevention of background stains and good fluidity. Granulation may be performed by, for example, pulverization, polymerization in an aqueous medium or a combination thereof.

The toner of the present invention including the above ingredients can be used in combination with a carrier as a two-component developer or alone as a one-component developer.

When the toner is used as a two-component developer, any conventionally known carrier such as iron powder, ferrite particles, and glass beads can be used. These carrier base particles may be coated with a resin. In this case, any conventionally known resin can be used. Specific examples of the resin include acrylic resins, polycarbon fluoride, polyvinyl chloride, polyvinylidene chloride, phenol resins, polyvinyl acetal and silicon resins. The carrier base particles generally has an average particle diameter of 10 to 1000 $\mu$m, preferably 30 to 500 $\mu$m. In general, the toner is mixed with the carrier in an amount of 0.5 to 6.0 parts by weight per 100 parts by weight of the carrier.

The charge control agent according to the present invention may be also used as a surface material which is desired to charge toner particles by frictional contact therewith. In a system for developing an electrostatic latent image using a single component developer, the toner has a smaller chance for frictional electronification as compared with a two-component developer which contains a carrier. Thus, so that the toner of the single component developer can be charged sufficiently within a short period of time, the charge control agent may be incorporated into a developer bearing member (such as developing roller or sleeve), a developer regulating member (such as a doctor blade) for adjusting the thickness of the developer layer on the developer bearing member or a toner feed roller.

One embodiment of a charging device is schematically illustrated in FIG. 1 in which reference numeral 1 denotes a latent image carrier (photoconductor), 2 a developing roller, 2-1 is a core, 2-2 a resin coat layer, 3 a toner supplying member, 4 an electrostatic charge image developer applying blade, 5 an agitator, and 6 denotes a developing region. The developing roller 2 is a structure in which a surface layer, whose main component is silicone resin, is provided as the resin coat layer on the core 2-1. The toner supplying roller 3, which is formed from a polyurethane material and which abuts the developing roller 2, and the blade 4, which is formed from a urethane material and which abuts the developing roller 2, are set. The charge control agent according to the present invention may be incorporated into the developing roller 2 the developer regulating member 4 or the toner feed roller 3.

The following examples and comparative examples will further illustrate the present invention. Parts are by weight. The term "environment dependency" as used in the examples is defined by the following equation:

$$Ed=2(Q_{LL}-Q_{HH})/(Q_{LL}+Q_{HH})\times 100\%$$

wherein Ed represents the environment dependency (%), $Q_{LL}$ represents the charging amount ($\mu$C/g) in a low temperature and low humidity environment (at 10° C. under relative humidity of 15%), and $Q_{HH}$ represents the charging amount ($\mu$C/g) in a high temperature and high humidity environment (at 30° C. under relative humidity of 90%).

EXAMPLE 1

| Preparation of developer: | |
|---|---|
| Styrene-methyl acrylate copolymer resin | 100 parts |
| Carbon black | 10 parts |
| Palmitic acid calcium salt | 1.5 parts |

The above ingredients were thoroughly mixed with a Henschel mixer and the mixture was kneaded with a roll mill at 130 to 140° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.5 part of hydrophobic silica and 0.2 part of titanium oxide as external additives to obtain a toner. The toner (2.5 parts) was mixed with 97.5 parts of iron carrier having a particle size of 100 to 250 mesh using a Turbler mixer to obtain a developer.

Evaluation:

The developer obtained above was charged in a copying machine, IMAGIO MF530, manufactured by Ricoh Company, Ltd. and images were reproduced at room temperature environment. Uniform images having a high image density and free of background stains or transfer failure were obtained in the initial copying stage. No image defects were detected even after production of 50,000 copies. The toner during developing operations was measured for the charging amount by a blow-off method to reveal that the initial charging amount was −23 μC/g and that the charge amount after production of 50,000 copies was −17 μC/g. Image reproduction was also carried out in a low temperature low humidity environment (10° C., 15% relative humidity) and in a high temperature high humidity environment (30° C., 90% relative humidity). Good images were found to be obtained in these environments, too. The environment dependency was found to be 44%.

COMPARATIVE EXAMPLE 1

| Preparation of developer: | |
|---|---|
| Styrene-methyl acrylate copolymer resin | 100 parts |
| Carbon black | 10 parts |
| Zinc salicylate | 2 parts |

Using the above ingredients, a toner was prepared in the same manner as described in Example 1. A developer was then prepared in the same manner as described in Example 1.

Evaluation:

The developer obtained above was tested in the same manner as that in Example 1. The initial charge amount was −21 μC/g. Uniform images having a high image density and free of background stains were obtained in the initial copying stage. However, background stains were detected after production of 50,000 copies. The charge amount after production of 50,000 copies was −14 μC/g. In the case of the low temperature and low relative humidity environment, good images were found to be obtained. In the case of the high temperature and high relative humidity environment, on the other hand, background stains occurred significantly. The environment dependency was 50%.

COMPARATIVE EXAMPLE 2

| Preparation of developer: | |
|---|---|
| Styrene-methyl acrylate copolymer resin | 100 parts |
| Carbon black | 10 parts |
| Calcium sulfate | 2 parts |

Using the above ingredients, a toner was prepared in the same manner as described in Example 1. A developer was then prepared in the same manner as described in Example 1.

Evaluation:

The developer obtained above was tested in the same manner as that in Example 1. The initial charge amount was −31 μC/g. Uniform images having a high image density and free of background stains were obtained in the initial copying stage. However, background stains were detected after production of 50,000 copies. The charge amount after production of 50,000 copies was −21 μC/g. In the case of the low temperature and low relative humidity environment, good images were found to be obtained. In the case of the high temperature and high relative humidity environment, on the other hand, background stains occurred significantly. The environment dependency was 59%.

EXAMPLE 2

| Preparation of developer: | |
|---|---|
| Styrene-butyl acrylate copolymer resin | 100 parts |
| Carbon black | 10 parts |
| Monohydroxymonocarboxynaphthalene-monosulfonic acid calcium salt | 2.5 parts |

Using the above ingredients, a toner was prepared in the same manner as described in Example 1. The toner thus obtained had a volume average particle diameter of 8.0±0.5 μm. A developer was then prepared in the same manner as described in Example 1.

Evaluation:

The developer obtained above was tested in the same manner as that in Example 1 except that a copying machine (manufactured by Ricoh Company, Ltd.) of an oil application type was used. The initial charge amount was −21 μC/g. Uniform images having a high image density and free of background stains were obtained in the initial copying stage. No image defects were detected even after production of 50,000 copies. The charge amount after production of 50,000 copies was −18 μC/g. Good images were found to be obtained in the low temperature and low relative humidity environment and in the high temperature and high relative humidity environment, too. The environment dependency was 34%.

EXAMPLE 3

| Preparation of developer: | |
|---|---|
| Styrene-butyl acrylate copolymer resin | 100 parts |
| Carbon black | 10 parts |
| Benzenesulfonic acid calcium salt | 2.5 parts |

Using the above ingredients, a toner was prepared in the same manner as described in Example 1. The toner thus obtained had a volume average particle diameter of 8.0±0.5 μm. A developer was then prepared in the same manner as described in Example 1.

Evaluation:

The developer obtained above was tested in the same manner as that in Example 1 except that a copying machine (manufactured by Ricoh Company, Ltd.) of an oil application type was used. The initial charge amount was −21 μC/g. Uniform images having a high image density and free of background stains were obtained in the initial copying stage. No image defects were detected even after production of 50,000 copies. The charge amount after production of 50,000 copies was −22 μC/g. Good images were found to be obtained in the low temperature and low relative humidity environment and in the high temperature and high relative humidity environment, too. The environment dependency was 22%.

EXAMPLE 4

Preparation of 5-Sulfoisophthalic Acid Calcium Salt:

268 Grams of 5-sulfoisophthalic acid sodium salt were placed together with 500 g of ion exchanged water in a reactor equipped with a stirrer. The contents in the reactor were heated with stirring to 80° C. so that the sodium salt was dissolved in water. A solution of calcium chloride dissolved in an amount of 55.5 g into 100 g of ion exchanged water was then gradually added dropwise to the thus obtained solution. The resulting mixture was concentrated by evaporation to remove 250 g of water and then cooled to 10° C. and filtered to separate white precipitates. The precipitates were dispersed in 300 g of ion exchanged water. The dispersion was heated to 80° C., maintained at that temperature for 1 hour, cooled to 10° C. and then filtered. The precipitates were washed with water. Such a procedure including dispersion, heating, filtration and washing steps was repeated once more. The thus obtained precipitates were dried at 150° C. for 5 hours to obtain 141 g of 5-sulfoisophthalic acid calcium salt of the formula (3) shown below as a white powder.

(3)

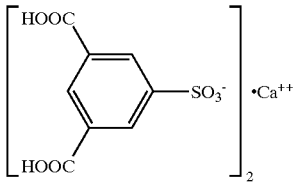

The atomic absorption analysis revealed that the 5-sulfoisophthalic acid calcium salt powder contained 7.5% by weight of calcium.

| Preparation of developer: | |
|---|---|
| Styrene-methyl acrylate copolymer resin | 100 parts |
| Carbon black | 10 parts |
| 5-Sulfoisophthalic acid calcium salt (compound of the formula (3)) | 2 parts |

The above ingredients were thoroughly mixed with a Henschel mixer and the mixture was kneaded with a roll mill at 130 to 140° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.5 part of hydrophobic silica and 0.2 part of titanium oxide as external additives to obtain a toner. The toner (2.5 parts) was mixed with 97.5 parts of iron carrier having a particle size of 100 to 250 mesh using a Turbler mixer to obtain a developer.

Evaluation:

The developer obtained above was charged in a copying machine, IMAGIO MF530, manufactured by Ricoh Company, Ltd. and images were reproduced at room temperature environment. Uniform images having a high image density and free of background stains or transfer failure were obtained in the initial copying stage. No image defects were detected even after production of 50,000 copies. The toner during developing operations was measured for the charging amount by a blow-off method to reveal that the initial charging amount was −22 μC/g and that the charge amount after production of 50,000 copies was −19 μC/g. Image reproduction was also carried out in a low temperature low humidity environment (10° C., 15% relative humidity) and in a high temperature high humidity environment (30° C., 90% relative humidity). Good images were found to be obtained in these environments, too. The environment dependency was found to be 24%.

EXAMPLE 5

| Preparation of developer: | |
|---|---|
| Polyester resin | 90 parts |
| Styrene-butyl acrylate copolymer resin | 10 parts |
| Carbon black | 10 parts |
| Polyethylene wax | 4 parts |
| 5-Sulfoisophthalic acid calcium salt (compound of the formula (3)) | 2 parts |

Using the above ingredients, a toner was prepared in the same manner as described in Example 1 except that 0.7 part of hydrophobic silica and 0.3 part of titanium oxide were used per 100 parts of the base toner particles. The toner thus obtained had a volume average particle diameter of 8.0±0.5 μm. A developer was then prepared in the same manner as described in Example 1.

Evaluation:

The developer obtained above was tested in the same manner as that in Example 1 except that a copying machine, MF-2200, manufactured by Ricoh Company, Ltd. was used. The initial charge amount was −22 μC/g notwithstanding the fact that the toner contained a wax. Uniform images having a high image density and free of background stains were obtained in the initial copying stage. No image defects were detected even after production of 50,000 copies. The charge amount after production of 50,000 copies was −21 μC/g. Image reproduction was also carried out in a low temperature low humidity environment and in a high temperature high humidity environment. Good images were found to be obtained in these environments, too. The environment dependency was 27%.

COMPARATIVE EXAMPLE 3

Example 4 was repeated in the same manner as described except that 5-sulfoisophthalic acid calcium salt (compound of the formula (3)) was substituted by dimethyl 5-sulfoisophthalate sodium salt (compound of the above formula (4) below)

(4)

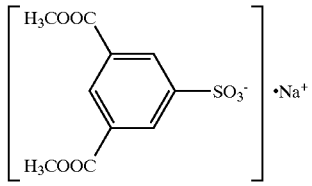

A developer was then prepared in the same manner as described in Example 4.

Evaluation:

The developer obtained above was tested in the same manner as that in Example 1. The initial charge amount was −20 μC/g. Uniform images having a high image density were obtained in the initial copying stage. However, slight background stains were detected. After production of 50,000 copies, slight background stains were still found. The charge amount after production of 50,000 copies was −18 μC/g. In the case of the low temperature and low relative humidity environment, results similar to the ambient conditions were found to be obtained. In the case of the high temperature and high relative humidity environment, on the other hand, significant background stains occurred significantly. The environment dependency was 63%.

COMPARATIVE EXAMPLE 4

Comparative Example 3 was repeated in the same manner as described except that 1.2 parts of hydrophobic silica and 0.3 part of titanium oxide were mixed with 100 parts of the toner particles. A developer was then prepared in the same manner as described in Example 4.

Evaluation:

The developer obtained above was tested in the same manner as that in Example 1. The initial charge amount was −24 μC/g. Uniform images having a high image density and free of background stains were obtained in the initial copying stage. After production of 50,000 copies, slight background stains were found. The charge amount after production of 50,000 copies was −16 μC/g. In the case of the low temperature and low relative humidity environment, results similar to the ambient conditions were found to be obtained. In the case of the high temperature and high relative humidity environment, on the other hand, significant background stains occurred significantly and transfer failure was observed. The environment dependency was 86%.

EXAMPLE 6

| Preparation of developer: | |
|---|---|
| Polyester resin | 100 parts |
| Carbon black | 10 parts |
| 5-Sulfoisophthalic acid calcium salt (compound of the formula (3)) | 2 parts |

Using the above ingredients, a toner was prepared in the same manner as described in Example 5. A developer was then prepared in the same manner as described in Example 5.

Evaluation:

The developer obtained above was tested in the same manner as that in Example 5. The initial charge amount was −21 μC/g. Uniform images having a high image density and free of background stains were obtained in the initial copying stage. No image defects were detected even after production of 50,000 copies. The charge amount after production of 50,000 copies was −18 μC/g. Image reproduction was also carried out in a low temperature low humidity environment and in a high temperature high humidity environment. Good images were found to be obtained in these environments, too. The environment dependency was 29%.

EXAMPLE 7

| Preparation of developer: | |
|---|---|
| Polyester resin | 70 parts |
| Styrene-butyl acrylate copolymer resin | 30 parts |
| Carbon black | 10 parts |
| Polyethylene wax | 4 parts |
| 5-Sulfoisophthalic acid calcium salt (compound of the formula (3)) | 2.5 parts |

Using the above ingredients, a toner was prepared in the same manner as described in Example 5. A developer was then prepared in the same manner as described in Example 5.

Evaluation:

The developer obtained above was tested in the same manner as that in Example 5. The initial charge amount was −22 μC/g. Uniform images having a high image density and free of background stains were obtained in the initial copying stage even though a wax was contained. No image defects were detected even after production of 50,000 copies. The charge amount after production of 50,000 copies was −18 μC/g. Image reproduction was also carried out in a low temperature low humidity environment and in a high temperature high humidity environment. Good images were found to be obtained in these environments, too. The environment dependency was 13%.

EXAMPLE 8

Preparation of Dimethyl 5-Sulfoisophthalate Calcium Salt:

296 Grams of dimethyl 5-sulfoisophthalate sodium salt were placed together with 2000 g of ion exchanged water in a reactor equipped with a stirrer. The contents in the reactor were heated with stirring to 80° C. so that the sodium salt was dissolved in water. A solution of calcium chloride dissolved in an amount of 55.5 g into 900 g of ion exchanged water was then gradually added dropwise to the thus obtained solution. The resulting mixture was cooled to 30° C. and filtered to separate white precipitates. The precipitates were dispersed in 3000 g of ion exchanged water. The dispersion was heated to 80° C., maintained at that temperature for 1 hour, cooled to 30° C. and then filtered. The precipitates were washed with water. Such a procedure including dispersion, heating, filtration and washing steps was repeated once more. The thus obtained precipitates were dried at 120° C. for 5 hours to obtain 156 g of dimethyl 5-sulfoisophthalate calcium salt (Compound of the above formula (2)) as a white powder. The atomic absorption analysis revealed that the 5-sulfoisophthalic acid calcium salt powder contained 6.8% by weight of calcium.

| Preparation of developer: | |
|---|---|
| Polyester resin | 100 parts |
| Carbon black | 10 parts |
| Carnauba wax | 4 parts |
| Dimethyl 5-sulfoisophthalate calcium salt (compound of the formula (2)) | 2 parts |

Using the above ingredients, a toner was prepared in the same manner as described in Example 5. A developer was then prepared in the same manner as described in Example 5.

Evaluation:

The developer obtained above was tested in the same manner as that in Example 5. The initial charge amount was −24 μC/g. Uniform images having a high image density and free of background stains were obtained in the initial copying stage even though a wax was contained. No image defects were detected even after production of 50,000 copies. The charge amount after production of 50,000 copies was −21 μC/g. Image reproduction was also carried out in a low temperature low humidity environment and in a high temperature high humidity environment. Good images were found to be obtained in these environments, too. The environment dependency was 8%.

EXAMPLE 9

| Preparation of developer: | |
|---|---|
| Yellow toner: | |
| Polyol resin | 100 parts |
| Disazo yellow pigment | 5 parts |
| Dimethyl 5-sulfoisophthalate calcium salt (compound of the formula (2)) | 2 parts |
| Magenta toner: | |
| Polyol resin | 100 parts |
| Quinacridon magenta pigment | 4 parts |
| Dimethyl 5-sulfoisophthalate calcium salt (compound of the formula (2)) | 2 parts |
| Cyan toner: | |
| Polyol resin | 100 parts |
| Copper phthalocyanin blue pigment | 2 parts |
| Dimethyl 5-sulfoisophthalate calcium salt (compound of the formula (2)) | 2 parts |
| Black toner: | |
| Polyol resin | 100 parts |
| Carbon black | 6 parts |
| Dimethyl 5-sulfoisophthalate calcium salt (compound of the formula (2)) | 2 parts |

The above ingredients of each of the toners were thoroughly mixed with a Henschel mixer and the mixture was kneaded with a roll mill at 100 to 110° C. for about 30 minutes. The kneaded mixture was solidified by cooling to room temperature and the solid mass was grounded and sieved to obtain base toner particles having a volume average particle diameter of 8.0±0.5 μm. 100 Parts of the base toner particles were mixed with 0.7 part of hydrophobic silica and 0.6 part of titanium oxide as external additives to obtain a toner. The toner (5 parts) was mixed with 95 parts of iron carrier having a particle size of 100 to 250 mesh using a Turbler mixer to obtain a developer. The above procedures were conducted for each of the four color toners to obtain four kinds of developer.

Evaluation:

Each of the developers obtained above was charged in a copying machine, Priter 550, manufactured by Ricoh Company, Ltd. and full color images with good color tone were reproduced at room temperature environment. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −21 μC/g and that the charge amount after production of 50,000 copies was −18 μC/g. Image reproduction was also carried out in a low temperature low humidity environment and in a high temperature high humidity environment. Good images were found to be obtained in these environments, too. The environment dependency was 20%.

EXAMPLE 10

| Preparation of developer: | |
|---|---|
| Yellow toner: | |
| Polyol resin | 100 parts |
| Disazo yellow pigment | 5 parts |
| Carnauba wax | 4 parts |
| Dimethyl 5-sulfoisophthalate calcium salt (compound of the formula (2)) | 2 parts |
| Magenta toner: | |
| Polyol resin | 100 parts |
| Quinacridon magenta pigment | 4 parts |
| Carnauba wax | 4 parts |
| Dimethyl 5-sulfoisophthalate calcium salt (compound of the formula (2)) | 2 parts |
| Cyan toner: | |
| Polyol resin | 100 parts |
| Copper phthalocyanin blue pigment | 2 parts |
| Carnauba wax | 4 parts |
| Dimethyl 5-sulfoisophthalate calcium salt (compound of the formula (2)) | 2 parts |
| Black toner: | |
| Polyol resin | 100 parts |
| Carbon black | 6 parts |
| Carnauba wax | 4 parts |
| Dimethyl 5-sulfoisophthalate calcium salt (compound of the formula (2)) | 2 parts |

Using the above ingredients, four kinds of toners were prepared in the same manner as described in Example 9. Four kinds of developers were then prepared in the same manner as described in Example 9.

Evaluation:

Each of the developers obtained above was tested in the same manner as that in Example 9. Uniform images having a high image density and good color tone and free of background stains were obtained in the initial copying stage. No image defects were detected even after production of 30,000 copies. The magenta toner during developing operations was measured for the static charge amount by a blow-off method to reveal that the initial charge amount was −21 μC/g and that the charge amount after production of 30,000 copies was −19 μC/g. Image reproduction was also carried out in a low temperature low humidity environment and in a high temperature high humidity environment. Good images were found to be obtained in these environments, too. The environment dependency was 15%.

COMPARATIVE EXAMPLE 5

| Preparation of developer: | |
|---|---|
| Polyester resin | 100 parts |
| Carbon black | 10 parts |
| Polyethylene wax | 4 parts |
| Dimethyl 5-sulfoisophthalate sodium salt (compound of the above formula (4)) | 3 parts |

Using the above ingredients, a toner was prepared in the same manner as described in Example 5. A developer was then prepared in the same manner as described in Example 5.

Evaluation:

The developer obtained above was tested in the same manner as that in Example 7. The initial charge amount was −19 μC/g. The charge amount after production of 50,000 copies was −13 μC/g. Satisfactory image quality was obtained in the initial image. However, background stains were found after 50,000 copies. Image reproduction was also carried out in a low temperature low humidity environment and in a high temperature high humidity environment. In the case of the low temperature and low relative humidity environment, good images were found to be obtained. In the case of the high temperature and high humidity conditions, on the other hand, background stains occurred significantly. The environment dependency was 93%.

EXAMPLE 11

| Preparation of toner: | |
|---|---|
| Polyester resin | 90 parts |
| Styrene-butyl acrylate copolymer resin | 10 parts |
| Magnetite fine powder | 40 parts |
| Polyethylene wax | 4 parts |
| Dimethyl 5-sulfoisophthalate calcium salt (compound of the formula (2)) | 4 parts |

Using the above ingredients, a toner was prepared in the same manner as described in Example 7. The toner thus obtained had a volume average particle diameter of 8.0±0.5 μm.

Evaluation:

The toner obtained above was tested using a printing machine, IPSIO NX700 manufactured by Ricoh Company, Ltd. The printer had a one-component type developing device that required the developer to establish a properly charged state in a moment. Good images were obtained not only in the initial stage but also after production of 50,000 prints. The amount of charge of the toner sampled from a surface of the developing roller was −16 μC/g in the initial stage and was −15 μC/g after production of 50,000 prints. The printing operation was also carried out in a low temperature low humidity environment and in a high temperature high humidity environment. Good images were obtained in these environments, too. The initial charge amount was −17 μC/g in the case of the low temperature and low humidity environment and −15 μC/g in the case of the high temperature and high humidity environment. Thus the developer was found to be hardly influenced by environmental conditions.

COMPARATIVE EXAMPLE 6

| Preparation of toner: | |
|---|---|
| Polyester resin | 100 parts |
| Magnetite fine powder | 40 parts |
| Polyethylene wax | 4 parts |
| Calcium sulfate | 4 parts |

Using the above ingredients, a toner was prepared in the same manner as described in Example 7.

Evaluation:

The toner obtained above was tested in the same manner as described in Example 7. Images obtained in the initial stage were not uniform in image density. A toner thin layer formed on a surface of the developing roller was found to be irregular. The amount of charge of a toner sampled from the thin layer was −9 μC/g. When 50,000 sheets of images were produced, background stains were caused during the course of the printing operation. A toner thin layer formed on a surface of the developing roller after production of the 50,000 prints was found to be irregular. The amount of charge of a toner sampled from the thin layer was −4 μC/g. The printing operation was also carried out in a low temperature low humidity environment and in a high temperature high humidity environment. Good images were not obtained in these environments. The initial charge amount was −11 μC/g in the case of the low temperature and low humidity environment and −8 μC/g in the case of the high temperature and high humidity environment.

EXAMPLE 12

| Preparation of toner: | |
|---|---|
| Polyester resin | 100 parts |
| Magnetite fine powder | 40 parts |
| Carnauba wax | 4 parts |
| Fluorine-containing quaternary ammonium salt | 1 part |

Using the above ingredients, a toner was prepared in the same manner as described in Example 11. The toner thus obtained had a volume average particle diameter of 8.0±0.5 μm.

Preparation of Developing Roller:

A copying machine, M-10 manufactured by Ricoh Company, Ltd., was modified such that a metal roller of the developing roller was covered with a coating of an ion conductive solid rubber in which dimethyl 5-sulfoisophthalate calcium salt was dispersed in an amount of 35 parts per 100 parts of the solid rubber.

Evaluation:

The toner obtained above was charged in the above modified copying machine and copies were produced. Good images were obtained not only in the initial stage but also after production of 50,000 copies. The amount of charge of the toner sampled from a surface of the developing roller was +16 μC/g in the initial stage and was +13 μC/g after production of 50,000 copies. The copying operation was also carried out in a low temperature low humidity environment and in a high temperature high humidity environment. Good images were obtained in these environments, too. The initial charge amount was +18 μC/g in the case of the low temperature and low humidity environment and +16 μC/g in the case of the high temperature and high humidity environment.

COMPARATIVE EXAMPLE 7

The toner obtained in Example 12 was charged in a copying machine, M-10 manufactured by Ricoh Company, Ltd., which was not modified. Background stains were caused in the initial stage. A toner thin layer formed on a surface of the developing roller was found to be irregular. The amount of charge of a toner sampled from the thin layer was +6 μC/g. Background stains were caused throughout the course of image reproduction for 50,000 copies. The amount of charge of a toner sampled from a thin layer formed on a surface of the developing roller after production of the 50,000 copies was +7 μC/g. The copying operation was also carried out in a low temperature low humidity environment and in a high temperature high humidity environment. Good images were not obtained in these environments, either. The charge amount was +9 $\mu$C/g in the case of the low temperature and low humidity environment and +6 $\mu$C/g in the case of the high temperature and high humidity environment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2001-375887 filed Dec. 10, 2001, inclusive of the specification and claims, are hereby incorporated by reference herein.

What is claimed is:

1. A toner comprising: a calcium salt of an organic acid compound, represented by the following formula (1):

(1)

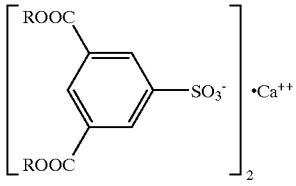

wherein R is a hydrogen atom or a hydrocarbon radical having 1 to 8 carbon atoms;

a colorant;

and a styrene-acrylate resin in which said calcium salt is dispersed.

2. The toner as claimed in claim 1, wherein R of the formula (1) is a methyl group.

3. The toner as claimed in claim 1, wherein the colorant is at least one selected from the group consisting of a magenta colorant, a cyan colorant, a yellow colorant and a black colorant.

4. The toner as claimed in claim 1, further comprising a releasing agent.

5. A developer comprising the toner as claimed in claim 1, and a carrier.

6. A method comprising:

reproducing an image with a developing device comprising a developing member and the developer according to claim 5.

7. The method as claimed in claim 6, wherein the developing device further comprises a thickness regulating member adjacent to the developing member and said method further comprises regulating the thickness of the developer present on the developing member.

8. The toner of claim of claim 1, wherein the styrene acrylate resin is a styrene-methylacrylate copolymer.

9. The toner of claim 1, wherein the styrene acrylate resin is a styrene-butylacrylate copolymer.

10. The toner of claim 1, comprising a styrene-methylacrylate copolymer resin, carbon black, and 5-sulfoisophthalic acid calcium salt.

11. The toner of claim 1, comprising dimethyl 5-sulfoisophthalate calcium salt.

12. A toner for developing an electrostatic latent image, comprising:

a polyester resin, a colorant and a charge control agent represented by the following (1)

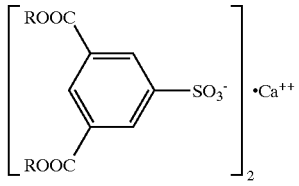

wherein R is a hydrogen atom or a hydrocarbon radical having 1 to 8 carbon atoms.

13. A toner as claimed in claim 12, wherein R of formula (1) is a methyl group.

14. A toner as claimed in claim 12, further comprising at least one releasing agent.

15. A toner as claimed in claim 12, wherein the colorant is selected from the group consisting of a magenta colorant, a cyan colorant, a yellow colorant and a black colorant.

16. A developer for developing an electrostatic latent image, comprising a carrier, and a toner according to claim 12.

* * * * *

UNITED STATES PATENT AND TRADEMARK OFFICE

CERTIFICATE OF CORRECTION

PATENT NO. : 6,977,129 B2
APPLICATION NO. : 10/314241
DATED : December 20, 2005
INVENTOR(S) : Saito et al.

It is certified that error appears in the above-identified patent and that said Letters Patent is hereby corrected as shown below:

Title page, Item [54] and Column 1, line l,
Title, should read -- CHARGE CONTROL AGENT, TONER USING SAME, DEVELOPER CONTAINING THE TONER AND DEVELOPING DEVICE CONTAINING THE DEVELOPER --.

Signed and Sealed this

Twentieth Day of June, 2006

JON W. DUDAS
*Director of the United States Patent and Trademark Office*